US005113197A

United States Patent [19]

Luh

[11] Patent Number: 5,113,197

[45] Date of Patent: May 12, 1992

[54] CONFORMAL APERTURE FEED ARRAY FOR A MULTIPLE BEAM ANTENNA

[75] Inventor: Howard H. S. Luh, Sunnyvale, Calif.

[73] Assignee: Space Systems/Loral, Inc., Palo Alto, Calif.

[21] Appl. No.: 458,104

[22] Filed: Dec. 28, 1989

[51] Int. Cl.[5] ..... H01Q 13/00

[52] U.S. Cl. ..... 343/776; 343/786; 343/772

[58] Field of Search ..... 343/776, 786, 705, 772

[56] References Cited

U.S. PATENT DOCUMENTS

| | | | |
|---|---|---|---|
| 2,677,055 | 4/1954 | Allen | 343/776 |
| 2,751,586 | 6/1956 | Riblet | 343/776 |
| 2,851,686 | 9/1958 | Hagaman | 343/786 |
| 3,045,238 | 7/1962 | Cheston | 343/776 |
| 3,482,251 | 12/1969 | Bowes, Jr. | 343/776 |
| 3,495,262 | 2/1970 | Paine | 343/776 |
| 3,500,417 | 3/1970 | Adams | 343/705 |
| 3,633,208 | 1/1972 | Ajioka | 343/786 |
| 4,757,324 | 7/1988 | Dhanjal | 343/776 |

*Primary Examiner*—Michael C. Wimer
*Assistant Examiner*—Hoanganh Le
*Attorney, Agent, or Firm*—Robert O. Guillot; Edward J. Radlo

[57] ABSTRACT

A multiple beam array antenna that is designed with an aperture shape which conforms to the particular coverage area to which the antenna is directed. The antenna consists of individual horn antennas (20) that are nested together to form the array (14). The outer walls (50) of the peripherally disposed horn antennas (40) are individually shaped such that the combined shape of the outer walls (50) of the peripherally disposed horn antennas (40) determine the perimeter shape of the aperture (12) of the horn array (14). Where the desired coverage area is circular, elliptical or irregularly shaped, the shape of the perimeter of the aperture (12) of the horn array (14) is similarly circular, elliptical or irregularly shaped, respectively.

3 Claims, 3 Drawing Sheets

CONFORMAL APERTURE FEED ARRAY FOR A MULTIPLE BEAM ANTENNA

BACKGROUND OF THE INVENTION

1. Field of the Invention

This invention relates generally to multiple beam antennas, and more particularly to a feed horn array for a multiple beam antenna having an overall peripheral aperture shape which is designed to conform to the shape of the desired coverage area of the antenna.

2. Description of the Prior Art

Multiple beam antennas utilizing an array of feed horns are known in the prior art. U.S. Pat. No. 3,633,208, issued Jan. 4, 1972 to James S. Ajioka, describes a shaped-beam antenna for earth coverage from a stabilized satellite. This device utilizes an array of circular horns which produce a desired beam shape. U.S. Pat. No. 4,757,324, issued Jul. 12, 1988 to Sutinder S. Dhanjal, describes an antenna array having hexagonal horns. The '324 patent points out a coverage deficiency in devices that utilize circular feed horn shapes and teaches that an increase in gain can be achieved by eliminating the gaps between the feed horns that are inherent in devices such as Ajioka that utilize circular horns. The utilization of variously shaped horns is also taught in U.S. Pat. Nos. 2,851,686; 3,045,238; 3,482,251; and 3,495,262.

A deficiency in the above-described prior art is that the peripheral shape of the aperture of the antenna feed horn array is not optimized in relation to the shape of the coverage area to which the antenna is to be directed. Optimization of the peripheral shape of the feed horn array aperture to conform to the desired coverage area results in improved gain.

SUMMARY OF THE INVENTION

The feed horn array for a multiple beam antenna (10) of the present invention includes a horn array (14) wherein the individual horns (30, 40) are shaped to nest together leaving no gaps between the individual horn apertures. In a typical array, centrally disposed horns (30) are surrounded by other peripheral horns (40). The peripheral horns are disposed such that segments of the walls (42) (44) of the peripheral horns are engaged with wall segments of other horns of the array, whereas other segments of the walls (50) of the peripherally disposed horns form the outer perimeter of the horn array. In the present invention the outer wall segments (50) of the peripheral horns (40) are individually shaped such that the overall perimeter shape of the horn array (12) is similar to the shape of the designated coverage area of the antenna. Thus, if the designated coverage area of the multiple beam antenna is circular (16) (such as the earth for a satellite antenna), the outer peripheral shape of the horn array (12) of the antenna (10) will be circular. Likewise, if the desired coverage of the multiple beam antenna is an ellipse (116), the outer peripheral shape of the horn array (112) will be elliptical. If the desired coverage area of the antenna is irregularly shaped (216), the outer peripheral shape of the horn array (212) will be irregular and similar to the shape of the coverage area (216).

It is an advantage of the present invention that it provides a multiple beam antenna which includes a feed horn array having an aperture configuration that has a peripheral shape which optimizes the gain throughout the coverage area of the antenna.

It is another advantage of the present invention that it provides a multiple beam antenna having a feed horn array whose aperture configuration has a peripheral shape that is similar to the peripheral shape of the coverage area to which it is directed.

The foregoing and other features and advantages of the present invention will be apparent from the following detailed description of the preferred embodiments which make reference to the several figures of the drawing.

IN THE DRAWINGS

DESCRIPTION OF THE PREFERRED EMBODIMENT

Figure 1:
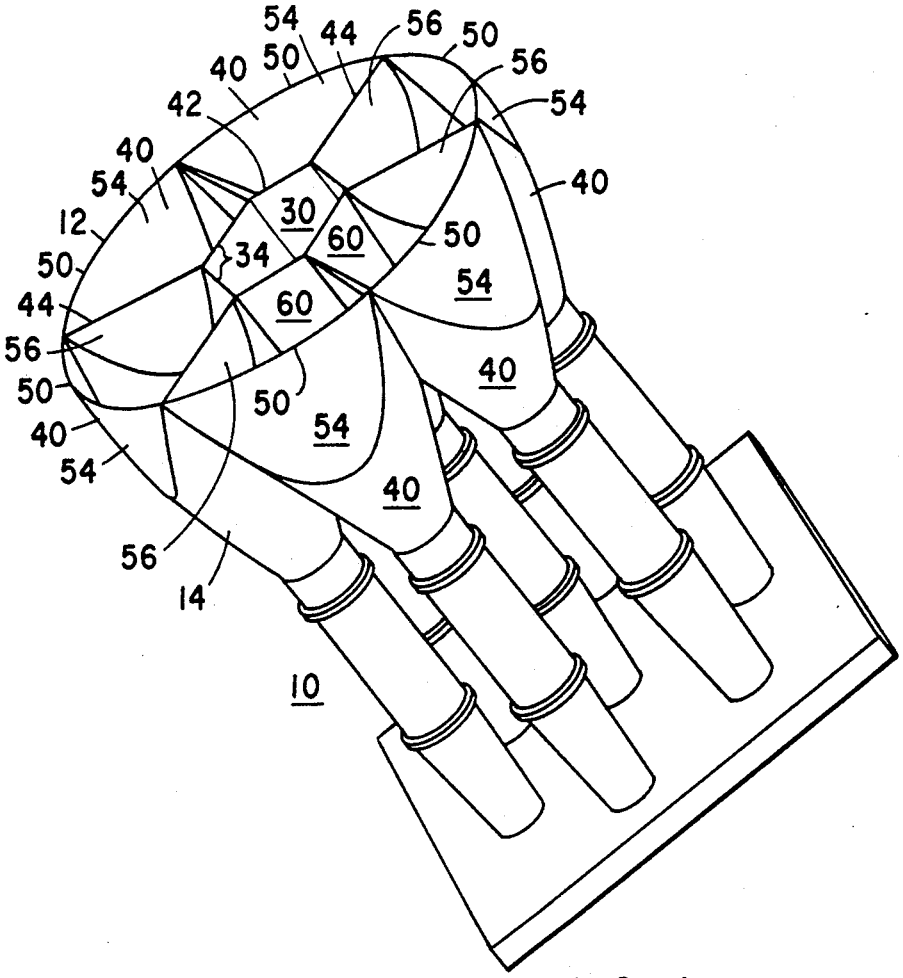
FIG. 1 is a perspective view of a conformal aperture feed horn array of a multiple beam antenna of the present invention.
Figure 2:
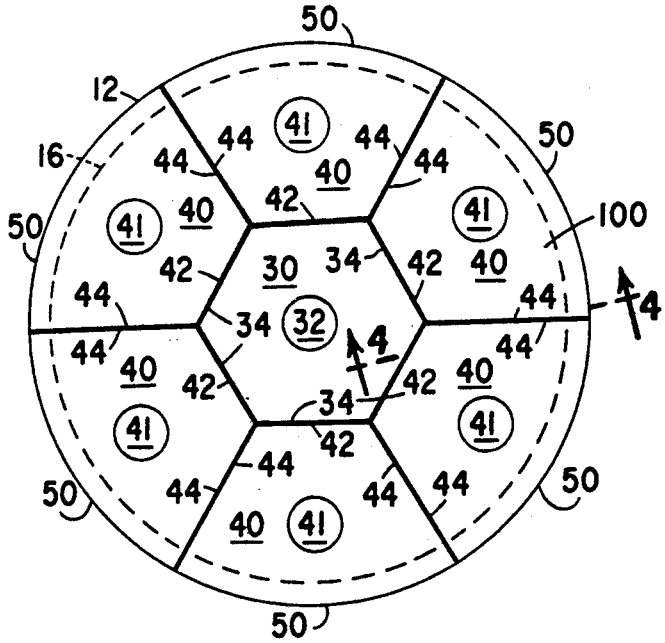
FIG. 2 is a top plan view of the conformal aperture feed horn array depicted in FIG. 1.

As depicted in FIGS. 1 and 2, the shape of the aperture 12 of the feed horn array 14 of the present invention 10 is designed to conform to the shape of the coverage area at which the horn will be directed. In the embodiment 10 depicted in FIGS. 1 and 2, the aperture 12 is circular, such that it is designed for a circular coverage area footprint 16 (shown in phantom in FIG. 2), as would be the case for a satellite antenna wherein the coverage area is the planet Earth. In this preferred embodiment, the feed horn array 14 is formed with a centrally disposed horn 30 having a waveguide emitting orifice 32 and a hexagonal aperture defined by six wall segments 34. Six peripherally disposed horns 40 surround the centrally disposed horn 30. Each of the peripherally disposed horns 40 has a waveguide emitting orifice 41 and an inner wall segment 42 contiguously engaged with or formed integrally with a wall segment 34 of the centrally disposed horn 30, as well as inner wall segments 44 that are contiguously engaged with or formed integrally with wall segments 44 of other peripherally disposed horns 40. The horn wall segments 34, 42 and 44 are conformed relative to each other such that no air gaps exist in the aperture 12 of the horn array 14.

A segment of the walls of each of the peripheral horns 40 forms an outer wall 50. The combined shape of the outer wall segments 50 of the peripheral horns 40 determine the shape of the periphery of the aperture 12 of the horn array 14. In the embodiment depicted in FIGS. 1 and 2 the aperture shape is circular. Thus the outer wall segment 50 of each of the peripherally disposed horns 40 comprises an arc-shaped portion of the circular aperture. To achieve a substantially homogenous signal from the antenna, each of the peripheral horns 40 is similar to each other, and, owing to the utilization of a hexagonally shaped central horn 30, the arc of the outer wall segment 50 of each horn 40 is 60 degrees.

Figure 3:
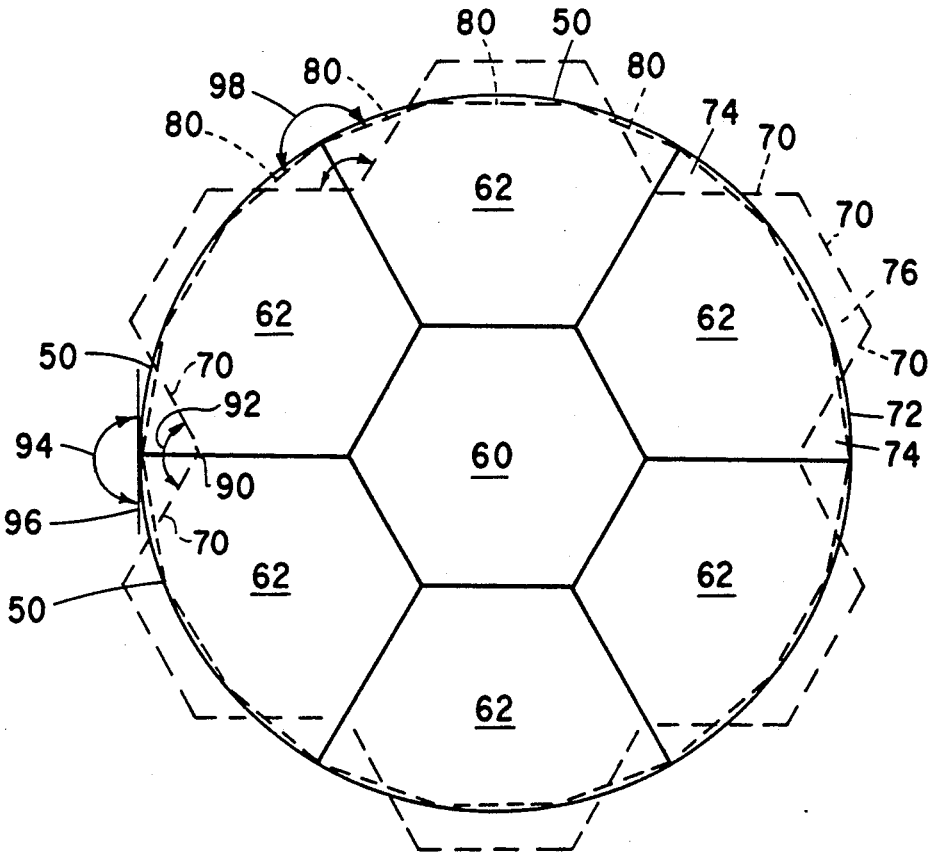
FIG. 3 is a top plan view showing the construction of the device depicted in FIG. 2.

FIG. 3 shows the construction of the device depicted in FIG. 2 and depicts a central hexagonal horn shape 60 surrounded by six peripheral hexagonal horn shapes 62. The central horn shape 60 corresponds to the central horn 30 of FIG. 2, and the peripheral horn shape 62 corresponds to the peripheral horns 40 of FIG. 2. The outer hexagonal wall segments 70 of each peripheral horn shape 62 are shown in phantom. In the preferred embodiment it is generally desirable that the area enclosed by the mouths of the centrally disposed horns 60 and the peripherally disposed horns 62 be substantially equal. Thus, as depicted in FIG. 3, the area enclosed by the hexagonal centrally disposed horn shape 60 and each of the hexagonal peripherally disposed horn shapes 62 are equal. The circle 72 represents the preferred circular perimeter of the aperture of a circular feed horn array such as that depicted in FIG. 2. The radius of the circle is chosen such that the combined total area of the two approximately triangular sections 74 of each outer horn 62 is approximately equal to the area of the approximately trapezoidal section 76. It is therefore to be understood that when the outer wall segments 70 of a hexagonally-shaped peripheral horn shape 62 are modified to a curved shape along circle 72, as described hereinabove, that the area of the two approximately triangular sections 74 will be included within the aperture of the modified peripheral horn shape 62, whereas the area of the approximately trapezoidal section 76 will be excluded. However, the total area of the mouth of the peripheral horn shape 62 will remain substantially unchanged.

The invention is not to be limited to a configuration in which the total area of the two sections 74 is exactly equal to the area of the section 76. Thus, a rigorous mathematical determination of the exact radius of the circle 72 is not necessary, it being within the ordinary skill of one in the art to mathematically determine it. Rather, the thrust of the invention lies in the shaping of the overall feed horn array aperture 12 to conform to the shape of the desired coverage area, and it being preferable that the area of the peripheral horns 40 be substantially equal to the area of the central horn 30.

FIG. 3 also depicts an alternative embodiment of the arc-shaped outer wall segment 50 that is within the scope of the present invention. Specifically, it has been found that the fabrication of an arc-shaped outer wall segment 50 is somewhat more difficult than the fabrication of straight wall segments. Thus, a suitable peripheral horn shape 62 may be fabricated having a plurality of straight outer wall segments 80 (shown in phantom) which provide a good approximation of the arc-shaped outer wall segment 50. While FIG. 3 shows an arc-shaped outer wall segment of each horn 62 being approximated by three straight wall segments 80, it is to be understood that the three wall segments 80 could be replaced by two wall segments, or even one straight wall segment that would provide acceptable results in that the overall perimeter shape of the aperture of the feed horn array would still approximate the circular shape of the desired coverage area.

The prior art includes multiple beam array antennas in which each of the feed horns have hexagonal shapes. A depiction of such prior art devices is found in FIG. 3, wherein the outer wall segments of the prior art devices are depicted by the phantom wall segments 70. In such prior art devices the intersection 90 of the outer wall segment 70 of two adjacent hexagonal peripheral horns is characterized by an exterior angle of intersection 92 that is less than 180 degrees. In the present invention, where the outer wall segments 50 of two adjacent peripheral horns 62 are curved, the exterior angle of intersection 94 is 180 degrees; that is, a tangent line 96. Additionally, where the outer wall of a peripheral feed horn 62 is formed from straight wall segments 80, the exterior angle of intersection 98 between the outer wall segments 80 of two adjacent peripheral horns 62 is greater than 180 degrees.

It is within the contemplation of the invention that a centrally disposed horn 30 could have an aperture that is other than hexagonal. Where such a centrally disposed horn is utilized, the peripherally disposed horns would be shaped such that the outer wall segments 50 of such horns when combined together would form an overall circular aperture.

Figure 4:
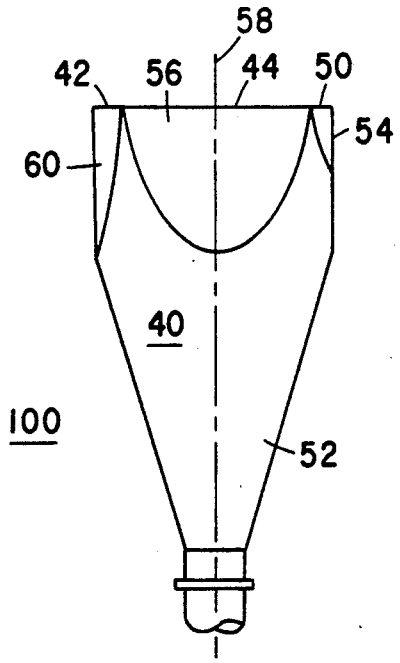
FIG. 4 is a side elevational view of one of the feed horns of the device depicted in FIGS. 1 and 2.

FIG. 4 depicts a side elevational view of a peripheral feed horn 40 of the device depicted in FIGS. 1 and 2. The shape of the horn at its base 52 is generally frustoconical. As described hereinabove, the outer wall segment 50 of the horn 40 is curved in an arc that forms a portion of the shape of the circular perimeter of the aperture of the array when a plurality of horns 40 are nested together as shown. Thus, a portion 54 of the surface of the horn 40 is necessarily changed from a conical shape 52 to an arcuate shape to create the necessary arc 50 that forms a portion of the perimeter of the array aperture 12. In the preferred embodiment, the surface 54 is made parallel to the central axis 58 of the horn 40. To facilitate the nesting of a plurality of horns 40, a flat surface 56 is formed in the conical surface 52 of the horn 40 proximate the contiguous walls 44 of the plurality of peripheral horns 40. The flat surface 56 facilitates the joinder, such as by soldering, of the contiguous walls of each horn. The joinder of the peripheral horns 40 with the central horn 30 is accomplished at a flat surface 60 formed in the conical surface 52 of the horn 40. Surface 60 mates with one of the corresponding flat surfaces formed in the wall segments of the centrally disposed horn 30.

Figure 5:
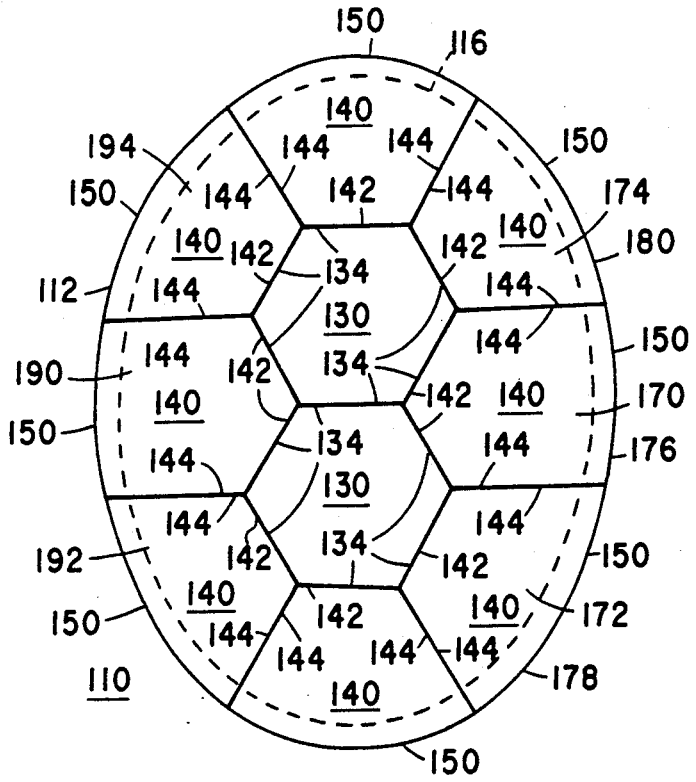
FIG. 5 is a top plan view of an embodiment of the present invention that is adapted for an elliptical coverage area.

FIG. 5 depicts the aperture end of an embodiment of the present invention wherein the horn array conforms to an elliptical coverage area footprint 116, shown in phantom. A comparison of FIGS. 2 and 5 reveals the many similarities between the circular aperture embodiment of FIG. 2 and the elliptical aperture embodiment of FIG. 5 wherein the similar structural elements of FIG. 5 are designated by similar numerals with 100 added. As shown, the elliptical aperture horn array 110 depicted in FIG. 5 includes two central feed horns 130 surrounded by a plurality of peripheral feed horns 140. Correspondingly configured wall segments 134, 142 and 144 join the horns 130 and 140 together such that no air gaps exist in the aperture 112 of the array. The outer walls 150 of the peripheral horns 140 are shaped into arc-shaped segments which combine to form an array aperture 112 that is elliptical in shape to conform to the elliptical coverage area footprint 116 shown in phantom.

A significant difference between the circular aperture array 10 depicted in FIGS. 1 and 2 and the elliptical aperture array 110 depicted in FIG. 5 is that the peripheral horns 140 are not all identical to each other. That is, horn 170 differs from the peripheral horns contiguous therewith, namely, horns 172 and 174. The particular difference between horn 170 and horns 172 and 174 is the shape of the peripheral arc segment 176 of horn 170 as compared to the arc segments 178 and 180 of horns 172 and 174, respectively. In the preferred embodiment of the elliptical aperture array device 110, the shape of horns 172 and 174 are mirror images of each other, such that signals of substantially equal power and mirror image shape will be emitted by them, whereby a more uniform signal will be transmitted by the antenna. Likewise, horns 190, 192 and 194 are mirror images of horns 170, 172 and 174, respectively, such that a more uniform signal will be transmitted by the antenna 110.

As with the earlier described embodiment, while the central horns 130 of the elliptical aperture horn array 110 are depicted as being hexagonal in shape, the invention is not to be so limited. Thus, the embodiment 110 contemplates central horns 130 having apertures that are otherwise than hexagonal. The number of central horns 130, peripheral horns 140 and the shape of the outer walls 150 of the peripheral horns 140 could also differ.

Figure 6:
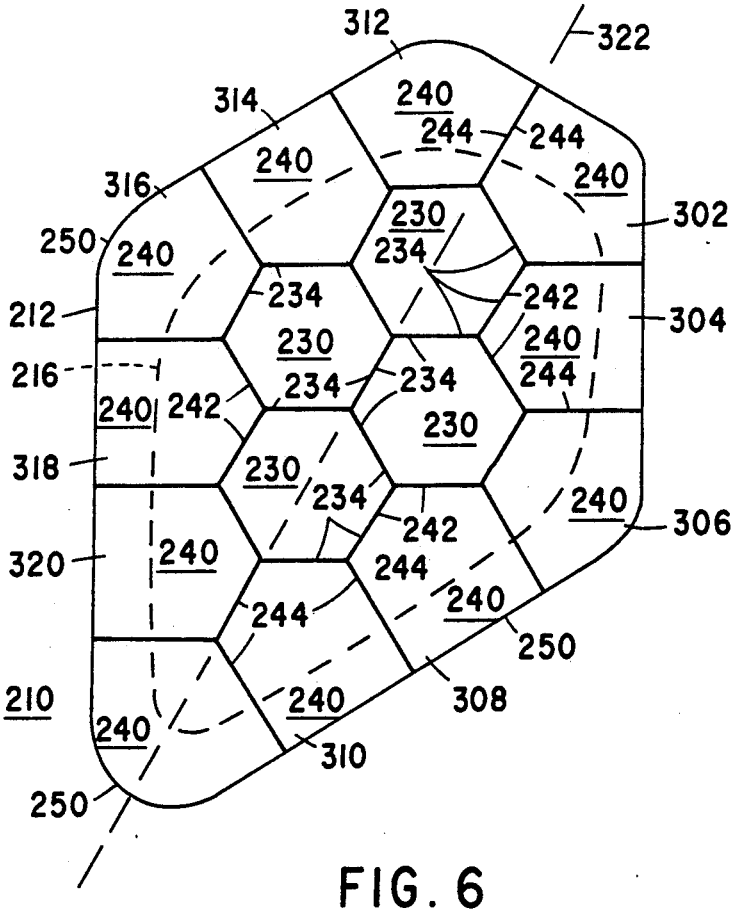
FIG. 6 is a top plan view of an embodiment of the present invention adapted for an irregularly shaped coverage area.

FIG. 6 depicts still another array antenna configuration 210 designed for an irregularly shaped coverage area. The coverage area footprint 216 for which the array antenna 210 is designed is depicted in phantom. A comparison of the aperture 212 of the horn array 210 with the shape of the coverage area 216 reveals that the aperture 212 is similar in shape although not identical to the coverage area 216. The horn array 210 has several similarities with the above described arrays 10 and 110 and similar structural elements shown in FIGS. 1 and 2 are designated by similar numerals (with 200 added) in FIG. 6. The horn array 210 includes a plurality of peripherally disposed horns 240 having similarly configured contiguous wall segments 244, and outer wall segments 250 which together define the shape of the overall aperture 212 of the horn array 210. It is to be noted that the horn array 210 includes a plurality of hexagonally shaped centrally disposed horns 230. The wall segments 234 of the centrally disposed horns 230 are similarly configured and matingly engaged to the wall segments 234 and 242 of other horns 230 and 240 respectively. However, the invention is not to be limited to the number, or shape, of the centrally disposed horns. It is to be understood that for clarity of depiction only the edges of the wall segments of the horns 230 and 240 which make up the horn array 210 are depicted in FIG. 6, as is also the case with FIG. 5.

In the preferred embodiment of the horn array antenna 210, it is preferable that the antenna provide a uniform signal across the coverage area. Thus, where possible, the aperture of the array 210 is preferably designed in mirror image horn shapes. That is, horns 302, 304, 306, 308 and 310 are the mirror images of horns 312, 314, 316, 318 and 320 respectively about a central axis 322 drawn through the horn array 210.

As is well known to those skilled in the art, an antenna can be used for both transmitting signals and receiving signals. Thus, the advantage of the present invention which results in increased gain on the transmission of signals also results in increased performance when the present invention is used as a receiving antenna.

While the invention has been particularly shown and described with reference to certain preferred embodiments, it will be understood by those skilled in the art that various alterations and modifications in form and detail may be made therein. Accordingly, it is intended that the following claims cover all such alterations and modifications as may fall within the true spirit and scope of the invention.

What I claim is:

1. A multiple beam antenna feed horn array, comprising:

a plurality of feed horns having end apertures disposed to collectively constitute the aperture of said array; at least two of said feed horns being disposed adjacent to each other and having wall segments which define a portion of the periphery of said aperture of said array;

a wall segment of one said feed horns being disposed adjacent to a wall of another of said feed horns, such that the angle of intersection between said two wall segments is greater than 180 degrees.

2. A feed horn, comprising:

a signal emitting portion and a flared horn portion;

said flared horn portion being defined by a plurality of wall segments and including a smaller, generally circular feed end and a larger generally non-circular aperture end;

said wall segments having outer edges which define the shape of said aperture of said horn;

a plurality of said edges of said walls being straight, and at least one edge of said walls being arc shaped.

3. A feed horn as described in claim 2 wherein a central axis is disposed along the length of said horn, and wherein a portion of a wall segment proximate said arc shaped edge is parallel to said central axis.

* * * * *